US005678820A

United States Patent [19]

Miller

[11] Patent Number: 5,678,820

[45] Date of Patent: Oct. 21, 1997

[54] BOARD GAME AND METHOD OF USING SAME

[76] Inventor: Frederick Miller, Rte. No. 02 Box 1577A, Lancaster, Va. 22503

[21] Appl. No.: 613,188

[22] Filed: Mar. 8, 1996

[51] Int. Cl.[6] ..... A61F 3/00

[52] U.S. Cl. ..... 273/249

[58] Field of Search ..... 272/242, 243, 272/248, 249

[56] References Cited

U.S. PATENT DOCUMENTS

| | | | |
|---|---|---|---|
| 2,194,854 | 3/1940 | Howard | 273/248 |
| 4,223,892 | 9/1980 | Matherne | 273/248 |
| 4,244,580 | 1/1981 | Hoyles | 273/248 X |
| 4,955,618 | 9/1990 | Growall | 273/249 X |
| 5,295,834 | 3/1994 | Saunders | 273/249 X |
| 5,340,113 | 8/1994 | Respicio | 273/249 |
| 5,377,991 | 1/1995 | Olsen | 273/249 |
| 5,386,994 | 2/1995 | Baranowski | 273/249 |
| 5,482,288 | 1/1996 | Cedeno | 273/249 |

*Primary Examiner*—William E. Stoll

*Attorney, Agent, or Firm*—Scott Garrison; Gary Lambert

[57] ABSTRACT

A game apparatus having a game board divided into a grid pattern. Playing paths are arranged to allow player tokens to progress along bordering grid squares in a predesignated manner until player's token enters a center area. Players are rewarded and penalized by landing on grid squares or landing on other player's tokens. Additional ziggurat zones are set aside on the game board providing players with the opportunity to further penalize other players for landing therein. The purpose of the game is to move all four of a specific player's tokens to the center of the board.

4 Claims, 8 Drawing Sheets

REMINDER CHART

LANDING ON

E = EXTRA DICE ROLL (Z) SCOOT

MOVE TO LAND ON (NEVER DOWNWARD)

S = SAFE FROM MOVABLE "IT" ; (NOT SAFE FROM TOKENS)

(↑ OPTIONAL, SEE RULES )

SENDS TOKEN BACK TO HI

SENDS TOKEN BACK TO HI

OPPONENT MOVABLE 'IT' TILE, SENDS TOKEN BACK TO HI

TOKENS:

OPPONENT LANDS TAKES SQUARE

BACK TO HI (↑ OPTIONAL, SEE RULES )

SAME COLOR LANDS

OR DIFFERENT COLOR TOKEN OPTION (SEE RULES

TAKES SQUARE BEHIND

8TH. ROW CORNER TOKEN PATH

-SAME COLOR ENTERS : PHEW

OTHERS

= TURNING CORNER

SAME COLOR LANDS ON

TAKES SQ. BEHIND OR HONORS SYMBOL ( OTHER COLOR TOKENS RETURN TO HI)

MOVABLE 'IT'

MOVABLE 'IT' ZONE (WITHIN ZONE) MOVEABLE 'IT' CAN MOVE

OR, STARTING IN ANY DIRECTION, ANY COMBINATION PER DIE PIPS

FIG. 8

BOARD GAME AND METHOD OF USING SAME

BACKGROUND OF THE INVENTION

The present invention relates to a board game and, more particularly, to a game board and methods of playing the same. Numerous games have been provided in the prior an that are adapted to be played with skill and are also games of chance. While these devices may be suitable for the particular purposes to which they address, they would not be suitable for the purpose of the present invention as hereinafter described.

SUMMARY OF THE INVENTION

A primary object of the present invention is to provide a plurality of players (two, three, or four), with an opportunity to be the first player to get all of that player's tokens into a center finish box in order to win the game. Each token is moved clockwise following a path, along grid square rows, around the board from row one to eight until the token enters the center finish box. Dice are rolled and the resulting number determines how many squares a token is to be moved. Each token is further advanced or penalized immediately as a token lands on a symbol square.

Another object of this invention is to provide a game apparatus suitable for persons of all ages, which is playable by a plurality of persons playing individually, and in which, although there are elements of chance, there exist substantial elements of skill.

An additional object of this invention is to provide a game apparatus in which the players may exercise substantial and intriguing offensive and defensive stratagems to accomplish offensive and defensive objectives.

It is another object of this invention to provide a board game which is challenging and exciting to play.

A further object of this invention is to provide an improved board game which is easy to store and use.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 8 is a pictorial view of a "reminder chart" which describes symbols and rules.

DETAILED DESCRIPTION OF THE PREFERRED EMBODIMENT

Figure 1:
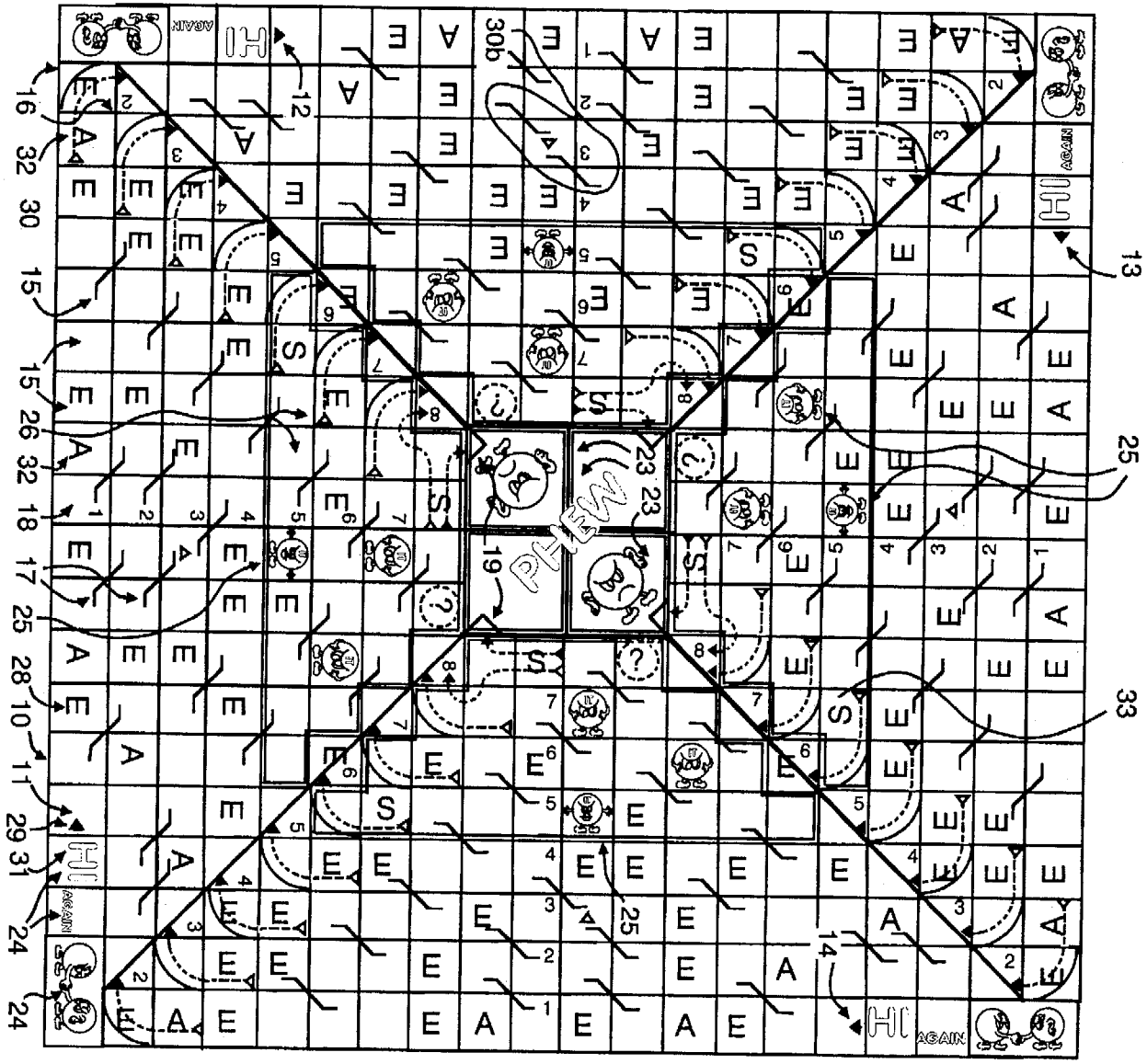
FIG. 1 is a plan view of a game board of the game apparatus constructed in accordance with the present invention.
Figure 2:
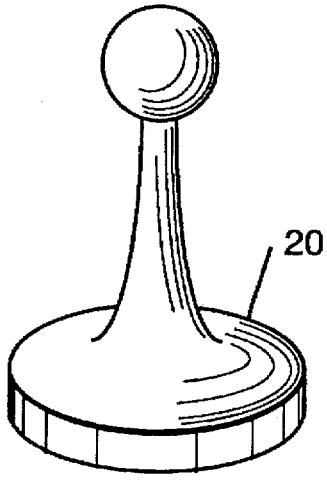
FIG. 2 is a pictorial view of a token for use by a player of the game apparatus of FIG. 1.
Figure 3:
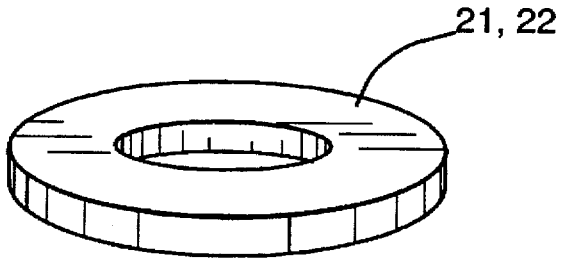
FIG. 3 is an oblique pictorial view of a tile for use by a player of the game apparatus of FIG. 1.

Referring now to the drawings and more particularly FIG. 1, a game board 10 is shown which is part of a game apparatus in accordance with the present invention, and which is used in accordance with the method of the present invention. The game board is to be constructed of a material possessing sufficient rigidity so as to accommodate its use as a game board with placement and movement of pieces thereon. Four continuous playing paths better illustrated in FIG. 6, referred to generally by the numerals 11, 12, 13, and 14, are provided on the surface of the board. The playing paths 11, 12, 13, and 14 are divided into a plurality of grid squares 15, for occupancy by means indicative of the players. The plurality of squares 15 define and form a plurality of continuous rows which delineate allowable movement of the players through the playing paths 11, 12, 13, and 14. Certain of the squares define and form cross-over zones 17 which allow movement by the players from one row to another.

Figure 5:
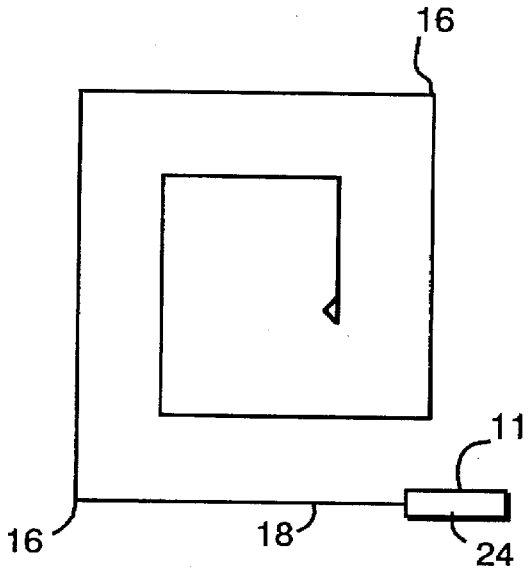
FIG. 5 depicts the configuration of each path as viewed from the base row.

The board game illustrated in FIG. 1 is essentially divided into four hundred equal grid squares 15; twenty to each side. The four start boxes 24 are equal to four grid squares 15 each and the center finish box 23 is equal to sixteen grid squares. Playing paths 11, 12, 13, and 14 are divided into three hundred and sixty eight grid squares 15, comprising the play area. Each of paths 11, 12, 13, and 14 contain ninety two adjacent grid squares 15 and seven ninety-degree corners 16, which form an eight-sided figure as depicted in FIG. 5. It is preferred that each grid square 15 be uniformly square and have its sides aligned with the sides of its contiguous grid squares. The term "contiguous grid squares" is defined for all purposes herein as two or more grid squares which are in contact, either horizontally, vertically or diagonally, with each other. Such an arrangement allows each grid square to come in contact with a plurality of other grid squares, creates uniformity in the playing paths and facilitates the utilization of control patterns, as will be explained hereinafter. The three hundred and sixty eight grid squares define and form four continuous paths 11, 12, 13, and 14, and nineteen cross-over zones 17. For purposes of identification, each cross-over zone 17 is depicted with a line leading from one grid square to the next marking the allowable movement of the players therethrough.

Figure 6:
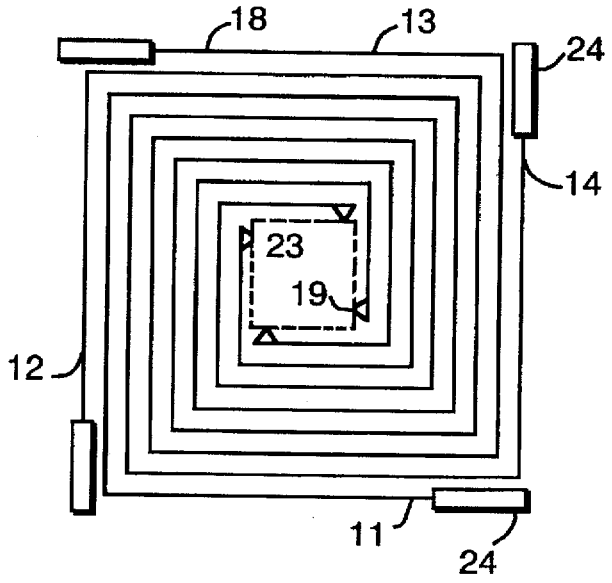
FIG. 6 depicts the configuration of all four paths when superimposed onto the game board of FIG. 1.
Figure 10:
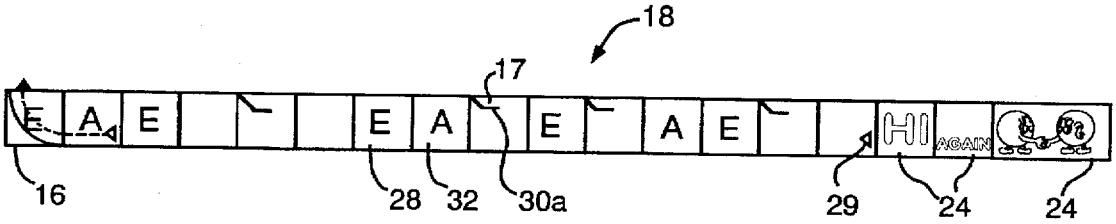
FIG. 10 is a pictorial view of a base leg (row one) of the FIG. 9 game board.
Figure 11:
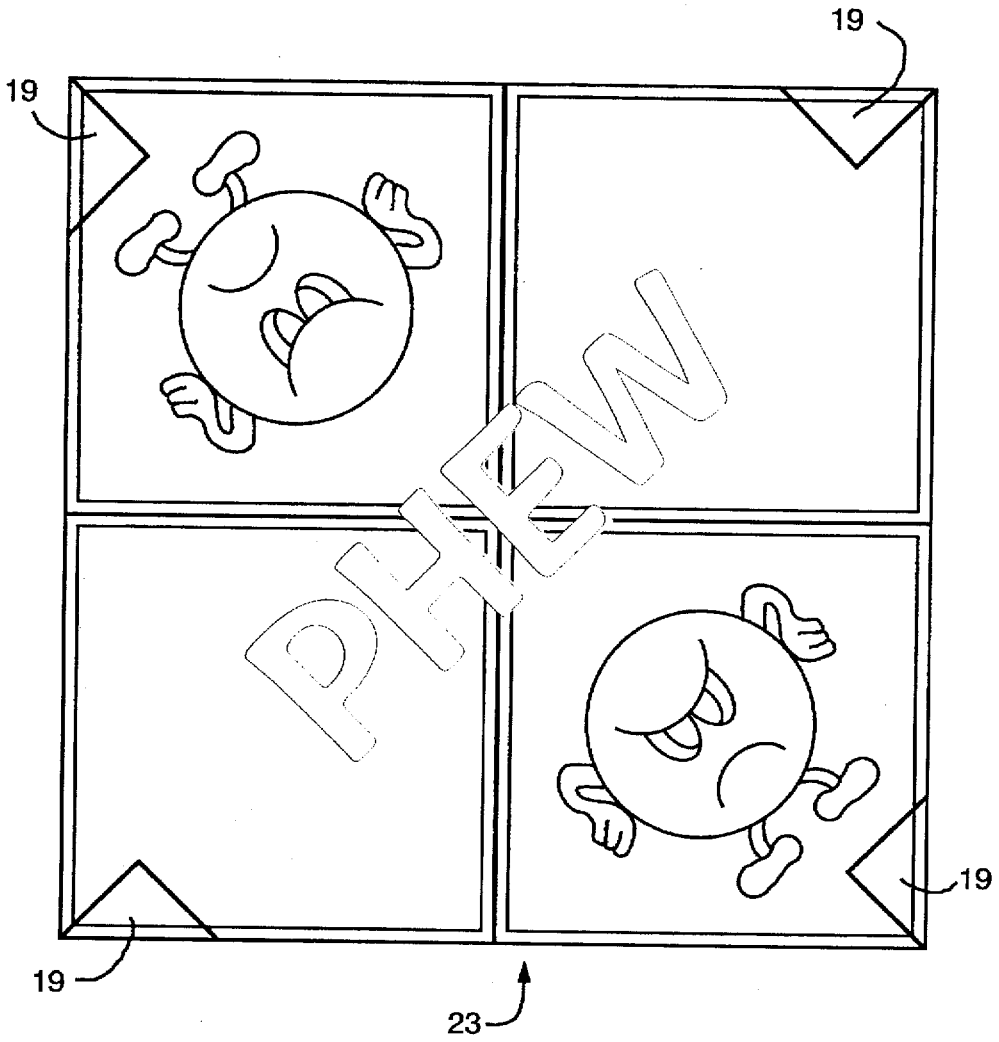
FIG. 11 is a pictorial view of a center finish box ("PHEW") of the FIG. 9 game board.
Figure 12:
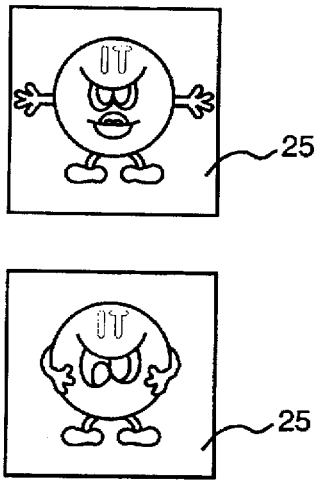
FIG. 12 is a pictorial view of a colored permanent "IT" square of the FIG. 9 game board.
Figure 13:
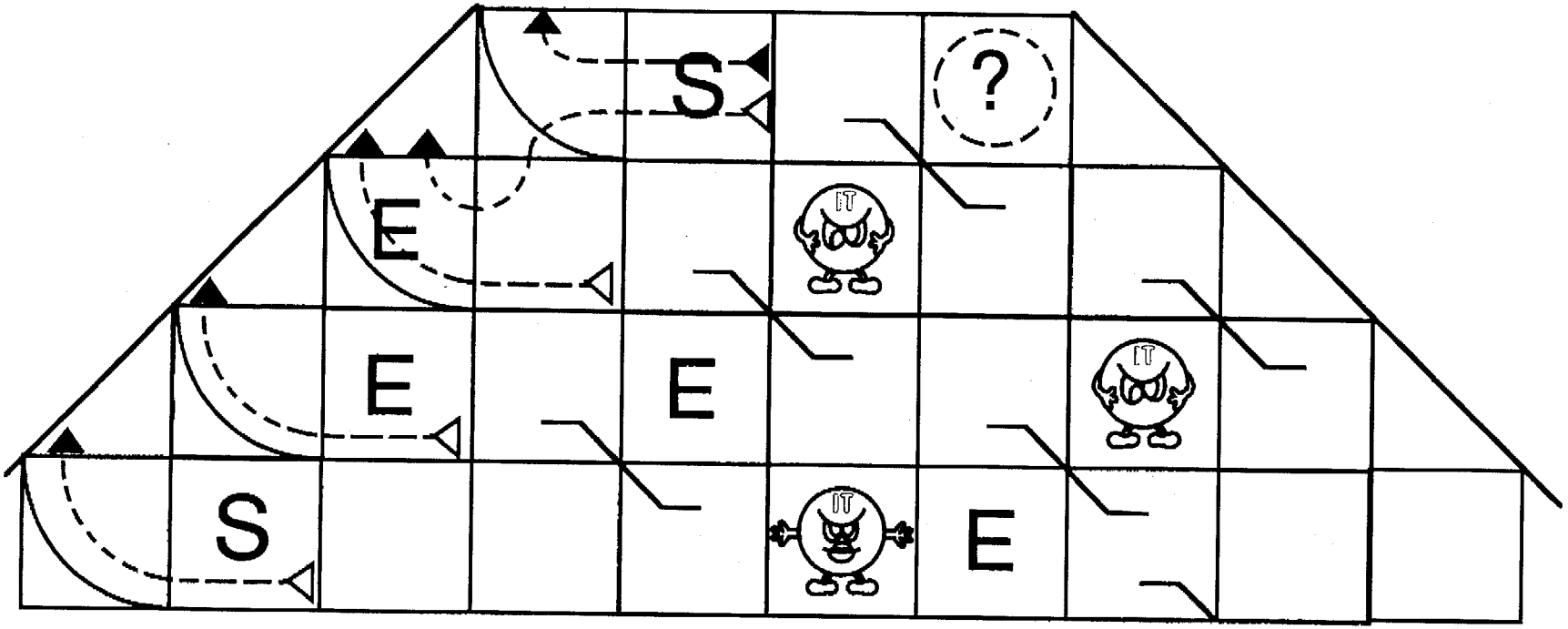
FIG. 13 is a pictorial view of a colored "IT" ziggurat zone of the FIG. 9 game board.

As shown in FIGS. 5 and 6, each of paths 11, 12, 13, and 14 start with a base leg 18 (row one) which runs parallel to the border of the board game. Base leg 18 shown in FIG. 10 comprises nineteen adjacent grid squares (fifteen play squares) and begins in a clockwise manner at one of the four different corner grid squares of the board. Row two begins directly and vertically above the last grid square of row one (square nineteen) at a ninety degree angle from the base leg 18 and forms a first corner 16. Row two extends seventeen squares to a next corner 16 where row three beginning grid square is placed adjacent and ninety degrees to the right. Row three contains fifteen grid squares (two less squares than row two). Each row thereafter up to row eight is two grid squares less than the previous row and corners 16 are formed as at all turns previously made. This configuration forms a square path of eight sides (rows) and seven corners 16, with four rows parallel when viewed from any board side. The path ending square intersects at ninety degrees to a finish box gate 19, considered the eighth corner. As can be seen from FIG. 1, all quadrants of the game board are identical, with the exception of a color chosen for that quadrant and graphics displayed in the center finish box.

A plurality of tokens 20 are provided for indicating the movement of the players through the playing paths 11, 12, 13, and 14. These tokens 20 should be distinctively colored to be indicative of each individual player. Each player begins with four tokens 20 of the same color. A plurality of colorless tiles 21 are also provided. The starter player is issued four tiles 21 and uses them to keep count of the number of player-entitled dice rolls. Additionally, four colored tiles 22 are provided, one tile 22 to each player.

OBJECT OF THE GAME

The object of the game is to be the first player to move all of that player's four tokens 20 from start box 24 into center "PHEW" box 23. The entrance to center "PHEW" box 23 for a particular player is dependent on the color of that player's tokens, i.e. a player with green tokens must enter the center box 23 through the green-colored arrow gate 19. During the game, players have the chance to send opponent player's tokens 20 back to their respective start boxes 24 by the use of movable colored tiles 22, in an effort to keep opponent players from getting all of their respective tokens 20 into the center "PHEW" box 23 first.

THE GAME

The game is begun by the players (two, three, or four) selecting their token color. Representative token colors can be green, red, yellow and blue, although other colors and combinations of the foregoing may be used. Each player places four tokens 20 of the same color, one behind the other, in the "HI" start box 24. Start box 24 contains four squares 15 and each token 20 is placed one within each grid square 15 forming start box 24. The color of the tokens 20 and start box 24 must be the same. Each player places a movable, colored tile 22, containing the same color as that chosen for that player's tokens 20 and start box 24, on the darkest matching colored permanent "IT" square 25 in each of the four color-coded "IT" ziggurat zones 26. Ziggurat zones 26 have the same colors as tokens 20 and colored tiles 22. The purpose of ziggurat zones 26 is to provide a safe zone for tokens 20 of the same color of ziggurat zone 26.

Figure 4:
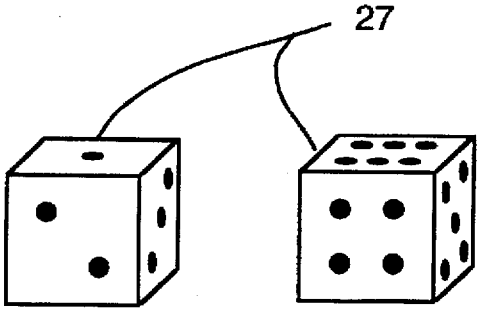
FIG. 4 is a pictorial view of two move determining devices of the game apparatus of FIG. 1.

The tokens 20 are moved pursuant to the roll of two six-sided dice 27, shown in FIG. 4, which have one of the numbers one through six on each side. Preferably, dice 27 are cast in throw boxes to prevent token displacement on the game board. The player throwing the highest dice pip count starts first, with players to the left following in turn. The starter player is issued four colorless tiles 21 and uses these to keep count of the number of player-entitled dice rolls. The dice 27 are rolled to determine how many squares a token 20 is to be moved. Each player is allowed four rolls of dice 27 per turn for token 20 movement. Doubles (explained below) and/or "E" square 28 landings add rolls to the basic four-roll turn. Regardless of how many tokens 20 a player may have in "PHEW" 23 (center box), the basic turn is always at least four rolls of dice 27.

Upon rolling the dice 27, which determines the amount of squares 15 a token 20 will be moved, token 20 is moved clockwise following path 11, 12, 13, or 14, along the square rows, around the board from row one to eight until token 20 can enter "PHEW" 23. On first turns of all players, all four tokens 20 of one player are moved out of the "HI" start box 24 one after another, counting arrow square 29 as the first square for each token 20. On subsequent turns, the highest row token 20 is moved first unless there are tokens 20 in start box 24. If tokens 20 are in start box 24, they must be moved first. After so doing, then a token 20 on the next lower row below the last moved token 20 is always the order of token-move sequence. Once there are no tokens 20 below the last moved token 20, the highest row token 20 is moved and the lower-row-move sequence continues until the turn ends. Should two or more tokens 20 occupy the same row upon which a move is to occur, the player has the option as to which to move on that particular row. Often, not all four tokens 20 are moved per turn due to token row changes and/or more than one token 20 on the same row. This will become evident as one plays the game. Corners 16 insure that tokens 20 moved along paths 11, 12, 13, and 14 are automatically moved along a higher row.

Figure 7:
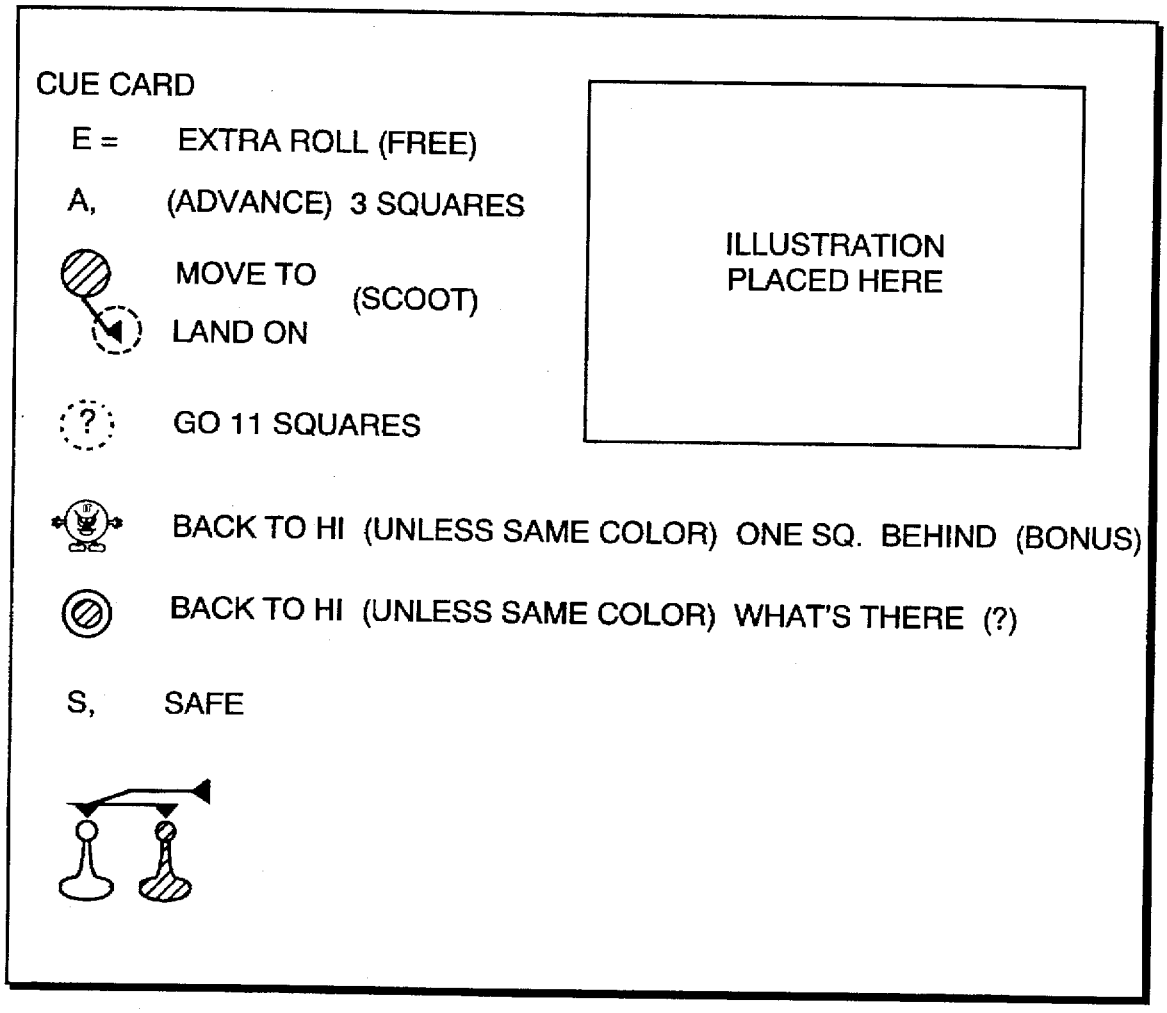
FIG. 7 is a pictorial view of a "cue card" which is provided to each player.
Figure 9:
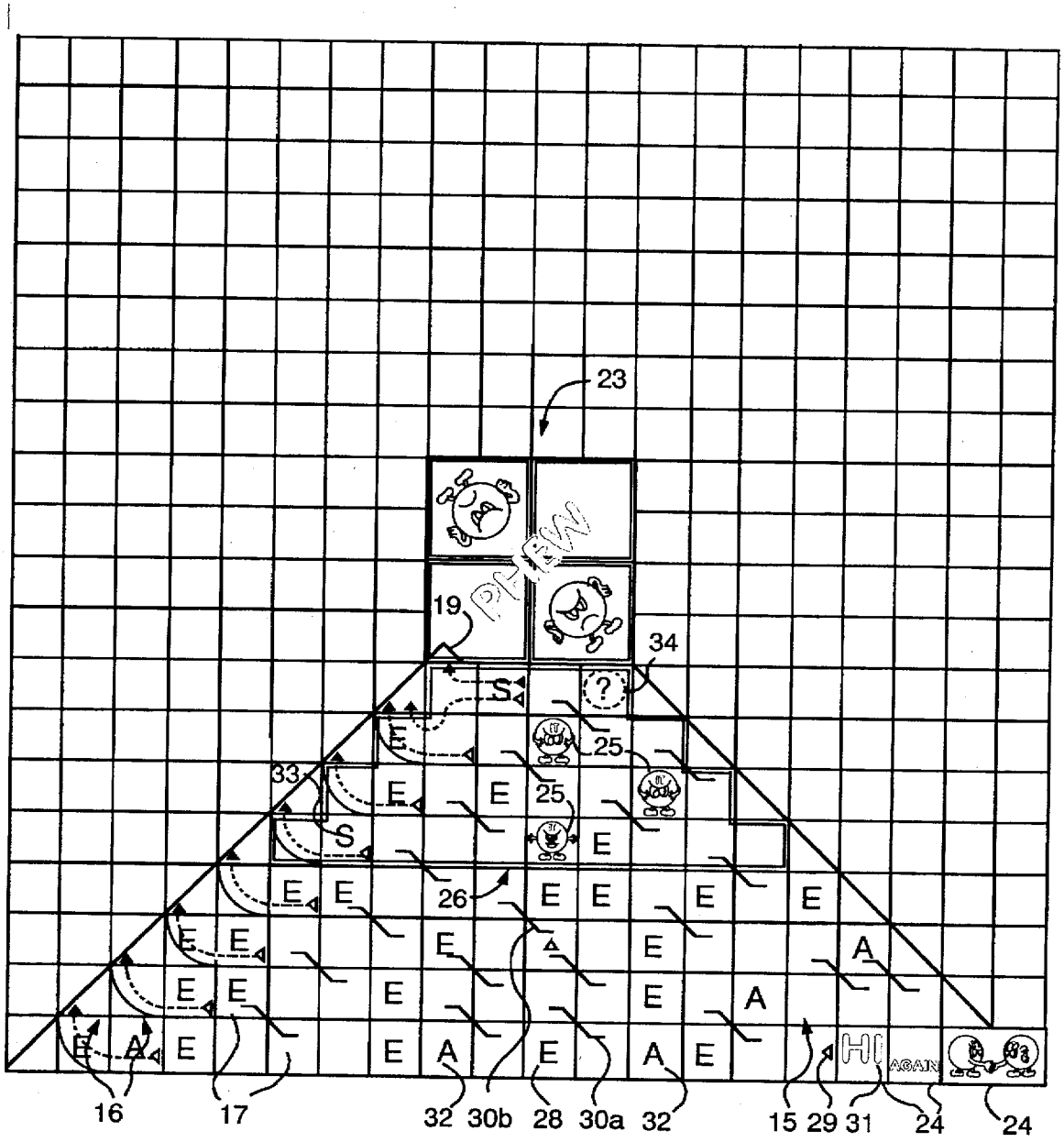
FIG. 9 is a plan view of the FIG. 1 game board depicting a single quadrant superimposed upon said game board.

As tokens 20 are moved about the game board, certain symbols emplaced within and/or without squares 15 have an effect on a "landing" token 20. The definition of these board symbols are shown in FIGS. 7 and 8, and are more fully discussed as follows. A token 20 landing on a grid square 15 containing an "E" 28 allows the player an extra roll of dice 27. In this case, dice 27 are thrown again and token 20 is moved respectively. In another case, if token 20 lands on a grid square 15 that has a "scoot" line 30*a*, signifying a cross-over zone 17 leading up to a diagonal grid square 15 in the next upper row, then the token 20 is moved from the lower grid square 15 diagonally up one row to the upper grid square 15. Occasionally, the player may encounter a "double scoot" line 30*b* which allows that player to move up diagonally two rows via two grid squares 15. If token 20 lands on an "A" square 32, this signals the player to advance token 20 three squares to the nearest "scoot" line 30*a*, which moves token 20 up a diagonal grid square 15. A token 20 landing on colored permanent "IT" square 25 signifies that token 20 must be returned to the "HI" box 31 in start box 24, unless the player lands on "IT" square 25 in his own color ziggurat zone 26, in which case token 20 is placed one grid square 15 behind square 25. A token 20 landing on broken-circled "?" square 32 signifies that token 20 must be advanced eleven squares 15, which most often places token 20 into center finish box 23. Grid Square 15 containing an "S" 33 indicates that if a token 20 lands on "S" 33, token 20 situated thereon is safe from attack by movable, colored tiles 22, discussed below, but not safe from opponent tokens 20. Throughout playing paths 11, 12, 13, and 14, corners 16 contain symbols reflecting dotted lines and small arrows, however, these symbols have no advancing properties with respect to tokens 20 and are for informational purposes only. Additionally, the diagonal lines shown near corners 16 help establish the row rank of the token 20 and serve no other purpose.

Each player is provided with a colored tile 22 reflecting the color chosen by or assigned to that player. This colored tile 22 is also referred to as a movable "IT". Colored tiles 22 are used to "attack" opponent tokens 20. Tiles 22 are moved only within their respective color ziggurat zone 26, but can land on any grid square 15 except a token-occupied "S" square 33. Tile 22 is moved pursuant to the pip count after one roll of one of dice 27 which occurs after a player ends the basic four-roll turn. Tile 22 can be moved horizontally or vertically or in any combination of horizontal and vertical squares 15 equal to the number of pips on one of dice 27, but never counting any grid square 15 outside the respective ziggurat zone 26. As with the permanent "TT" square 25, tokens 20 of one color landing on a different color movable tile 22 are returned to "HI" box 31, whereas tokens 20 of the same color that land on tile 22 are placed one grid square 15 behind the location of tile 22, occupying the grid square 15 or taking advantage of any symbol thereon. Additionally, by movement of a player's tile 22 and its landing on an opponent player's token, that token 20 is sent back to "HI" box 31 and player's tile 22 takes grid square 15 and remains there until tile 22 can move again. "TT" tile 22 cannot land on a token 20 of its same color nor can it take advantage of a favorable symbol upon which it may land. Furthermore, "TT" tile 22 can only be moved if and when an opponent player's token 20 is in the same colored ziggurat zone 26 as tile 22. In the event that less than four players are playing the game, each player has the option to use any colored tile 22 except those of an opponent player(s) during any one "TT" dice 27 roll in one available ziggurat zone 26 when a move is possible therein. That player may roll one of dice 27 prior to ziggurat zone 26 selection if more than one available zone 26 contains a token 20 that is susceptible to attack. It is important to note that tokens 20 are not affected by any symbol, token, tile, or movable "TT" it passes prior to landing on a grid square 15.

As discussed, if token 20 of one color lands on permanent "TT" square 25 or movable "TT" tile 22 of a different color, token 20 must be returned to "HI" box 31. If a token 20 is returned to box 33 during a turn, token 20 must be immediately moved out of box 31 on the next available turn of that player if the player is entitled to another roll of dice 27. The move sequence, however, remains in effect, i.e. the "HI" box 31 exiting token 20 is the last moved token out of the four tokens 20, such that any token 20 on a row below must be moved first before the highest row token 20.

Whenever a roll of dice 27 produces "doubles" (both dice 27 showing the same number of pips), this allows the player who threw the doubles to roll again in order to move the same token 20 previously moved. If a player has thrown a double prior to landing on an "E" square 28, then that player is allowed only one extra roll. However, should that player then again roll a double, the player thereafter plays a normal double and continues to move the same token 20. If a double is thrown to reach an "A" square 32, the player who threw the double completes the move before throwing dice 27 again (i.e. move to scoot line 30*a* and up a row). For a double to any scoot line 30*a* or 30*b*, the player also completes the move before the double throw. A token 20 must continue to be moved when a double is thrown, but doubles do not alter penalty landings. In that case, the double extra roll is lost and the token 20 returned to "HI" box 31. When entering center finish box 23, no double adds a turn roll and any possible extra pips are not carried over to another token 20.

Occasionally, tokens 20 land on each other. Should token 20 of one color land on a token 20 of another color (opponent's token 20), including tokens 20 landing on "S" squares 33, the landing token 20 takes the grid square 15, sending opponent's token 20 back to :"HI" box 31. If token 20 lands on a token of the same color (or adjacent same-colored tokens 20), the landing token 20 is placed on grid square 15 behind this token, sending any opponent's token 20 thereon back, taking advantage of or being subjected to the penalty (as applies to color) of any symbol. If token 20 is on a permanent "TT" square 25 in its own colored ziggurat zone 26 and an opponent token 20 lands thereon, the situated token 20 and landing token 20 are sent back to "HI" box 31.

Several variations can be made to the game to make it more exciting for the players. For example, the players may elect to recognize the "?" symbol squares 32 as blank squares 15 or as a bonus square 34 which sends landing tokens 20 directly into center box 23.

The game time for 2 players is expected to be from 45 minutes to 1 hour and 1½ hours or more for 4 players.

STRATEGY

Players may opt to attack any opponent's tokens 20 or move to an unoccupied grid square 15 to lie in wait for an approaching token 20. When a token optional move is available, an attempt to keep tokens 20 on the same row, thereby allowing a susceptible token 20 a possible move, often assists advance of a higher row token 20 nearing center box 23. Furthermore, the placement of movable "TT" tile 22 on a grid square 15 which assists a player's own token landings is often a good move if no damage could otherwise be accomplished to opponent players. As players become more familiar with game play they also become better strategists.

PENALTIES

The penalty of the loss of two rolls of dice 27 is invoked on a player when he or she (1) fails to move any token returned to the start box immediately upon their next entitled roll; (2) dislodges any token which is in question of being replaced upon the proper square; or (3) casts any die which is not contained within the throw box.

While certain novel features of this invention have been shown and described and are pointed out in the annexed claims, it will be understood that various omissions, substitutions and changes in the forms and details of the device illustrated in its operation can be made by those skilled in the art without departing from the spirit of the invention.

I claim:

1. A game apparatus, comprising:

a game board divided into a plurality of squares, each of said squares arranged upon said game board such that all squares form a grid pattern upon said game board, a contiguous sequentially arranged series of such squares further defining a plurality of inwardly spiraling playing paths, each of said playing paths having a first and a second end and being identical with any other of said playing paths with respect to a quantity of squares contained therein;

a plurality of player pieces, said player pieces being indicative of a specific one of a plurality of players, wherein said player pieces further comprise a plurality of non-tile tokens and a tile, wherein said tokens each represent one of a plurality of player positions as the token advances along said playing path and said tile is capable of penalizing a player opponent if said tile is made to occupy the same square as one of said opponent players' tokens;

selecting means for selecting by chance a number; said number to determine the extent of movement of said player pieces upon said squares of said playing paths;

starting means, located at the first end of each of said paths, which determine an initial position of said tokens;

finishing means, located at the second end of each of said paths, which delineate a desired final position of said player tokens; and a tile movement region which defines an allowable region within which said tile can move about; wherein said tile movement region forms a single zone through which all player tokens must pass, each of said zones being indicative of one of said plurality of players, each such zone further defining a region of increased potential penalty to said opponent player in that said tile can be made to occupy the same square as said opponent players' token.

2. A game apparatus as claimed in claim 1 wherein at least a portion of said squares further comprise one of a plurality of penalizing indicia directing the player whose token lands thereon to move said token rearward to another square and at least another portion of said squares further comprise one of a plurality of rewarding indicia either directing the player whose token lands thereon to move said token forward to another square or to reward said player with an additional use of said selecting means.

3. A game apparatus as in claim 2 wherein there are four playing paths.

4. A game apparatus as claimed in claim 3 wherein said player's said tile is only capable of movement when at least one of said opponent players' tokens occupies said player's tile movement region and then only after a separate and distinct use of said selecting means.

* * * * *